US006551078B2

(12) United States Patent
Huang

(10) Patent No.: US 6,551,078 B2
(45) Date of Patent: Apr. 22, 2003

(54) PUMP ASSEMBLY FOR AN AQUARIUM

(76) Inventor: Yi-Chung Huang, No. 32, Alley 12, Lane 85, Chunghwa W. St., Yungkang City, Tainan Hsien (TW)

( * ) Notice: Subject to any disclaimer, the term of this patent is extended or adjusted under 35 U.S.C. 154(b) by 0 days.

(21) Appl. No.: 09/852,798

(22) Filed: May 11, 2001

(65) Prior Publication Data

US 2002/0168276 A1 Nov. 14, 2002

(51) Int. Cl.[7] ..... F04B 17/00

(52) U.S. Cl. ..... 417/420; 417/413.1; 417/521; 210/169

(58) Field of Search ..... 417/420, 412, 417/413.1, 538, 395, 396, 419, 201, 350, 423.14, 423.1, 521, 44.1; 210/169, 484

(56) References Cited

U.S. PATENT DOCUMENTS 4,043,914 A * 8/1977 Horvath ..... 210/169
4,145,289 A * 3/1979 Seroussi ..... 210/169
4,154,681 A * 5/1979 Shields et al. ..... 210/169
4,283,645 A * 8/1981 Hofmann ..... 310/87
5,188,516 A * 2/1993 Huang ..... 417/199.1
5,282,961 A * 2/1994 Ellis et al. ..... 210/169
5,599,174 A * 2/1997 Cook et al. ..... 417/413.1
6,164,932 A * 12/2000 Tominaga et al. ..... 417/413.1

* cited by examiner

*Primary Examiner*—Charles G. Freay
*Assistant Examiner*—Han L. Liu
(74) *Attorney, Agent, or Firm*—Jones, Tullar & Cooper, P.C.

(57) ABSTRACT

A pump assembly for an aquarium includes a water circulation pump having a first casing and an aeration pump having a second casing, wherein the aeration pump is operated by the magnetic field of a rotating magnetic shaft that is rotatably mounted in the water circulation pump. The first casing and the second casing are connected to each other. A lever in the aeration pump is reciprocated continually to draw air into the pump and discharge air into the aquarium due to the magnetic field of the rotating magnetic shaft so that the coil is unnecessary in the aeration pump. Consequently, the pump assembly can be marketed for a lower price and save energy when used.

3 Claims, 7 Drawing Sheets

10
20
200
106
23
22
221
21
102
101
103
104
105
100
11
111
112
113
12
24
241
242
25
251

PUMP ASSEMBLY FOR AN AQUARIUM

BACKGROUND OF THE INVENTION

1. Field of the Invention

The present invention relates to a pump assembly, and more particularly to a pump assembly for an aquarium. The pump assembly for an aquarium in accordance with the present invention can simultaneously pump both water and air into an aquarium.

2. Description of Related Art

As is well know, an aquarium usually needs two pumps, one to circulate water and the other to aerate the water in the aquarium.

With reference to FIGS. 6 and 7, a conventional water circulation pump for an aquarium in accordance with the prior art comprises a first casing (50) and a stator device (not numbered) mounted in the first casing (50). The first casing (50) includes a first side having a positioning shaft (51) horizontally extending from the first side and a second side with a through hole (52) defined through the second side. A flange (53) extends out from the second side of the casing (50) around the through hole (52) and forms a pump cavity (530) within the flange (53). An outlet (54) is defined in the outer periphery of the first casing (50) and communicates with the pump cavity (530). An inlet (55) is defined in the outer periphery of the first casing (50) and communicates with the inside of the first casing (50).

A rotor (60) is mounted in the first casing (50). The rotor (60) comprises a sleeve (601), a magnetic shaft (61) and an impeller (62). A longitudinal hole (63) is centrally defined in the magnetic shaft (61) that is securely pressed onto the sleeve (601). The impeller (62) is also securely pressed onto the sleeve (601) so that when the magnetic shaft (61) rotates, the impeller (62) will rotate. The sleeve (601) is rotatably mounted on the positioning shaft (51), and the impeller is positioned in the pump cavity (530) of the first casing (50).

The first casing (50) further includes a cover (56) attached to the flange (53) to close the pump cavity (530) and form a water channel from the inlet (55) to the outlet (54) via the pump cavity (530). A second casing (70) is attached to the first casing (50) to securely hold the cover (56) in place. The second casing (70) has multiple suction cups (71) attached to the bottom of the second casing (70) to securely mount the water circulation pump on the aquarium.

Water is drawn into the pump cavity (530) through the inlet (55) and discharged into the aquarium from the outlet (54) by the impeller (62) to generate a water current in the aquarium when the rotor (60) rotates. The conventional water circulation pump for an aquarium in accordance with the prior art only pumps water into the aquarium to form a water current. Other functions must be performed by other pieces of equipment in an aquarium.

With reference to FIG. 8, the conventional aeration pump for an aquarium in accordance with the prior art comprises a casing (80), a coil (81), a cylinder (82), a tube (821), a lever (83), a C-shaped restitution device (84) and a magnet (831). The casing (80) is adapted to be mounted on an aquarium out of the water. The coil (81) is received in the casing (80) and mounted on one end of the casing (80). The coil (81) includes a wire (811) having one end electrically connected to the coil (81) and the other connected to a power source via an adapter (800). The cylinder (82) includes a first end mounted in the casing (80) opposite to the coil (81) and a second end having a diaphragm (822) attached to close the cylinder (82). The tube (821) has a first end inserted into the cylinder (82) and a second end extending through the casing (80). The lever (83) has a first end pivotally mounted on the inner periphery of the casing (80) and a second end extending toward and near the coil (81). The lever (83) is set across the diaphragm (822), and the diaphragm (822) has a protrusion (823) centrally extending out from the diaphragm (822) and secured on the lever (83). The C-shaped restitution device (84) is attached to the first end of the lever (83), and the magnet (831) is secured on the second end of the lever (83). The magnet (831) is moved reciprocally due to the changing electric field in the coil (81) when the coil (81) is powered so the diaphragm (822) will pump air into the aquarium through the tube (821). Other functions must be performed by other pieces of equipment in an aquarium.

The present invention has arisen to mitigate and/or obviate the disadvantages of the conventional pumps for an aquarium.

SUMMARY OF THE INVENTION

The main objective of the present invention is to provide a combination pump assembly that can pump both water and air into an aquarium. The pump assembly includes a water circulation pump having a first casing and an aeration pump having a second casing, wherein the aeration pump is operated by the electric field formed by a rotating magnetic shaft that is rotatably mounted in the water circulation pump. The first casing and the second casing are connected to each other. The lever of the aeration pump is moved up and down continually to draw air into the pump and discharge the air into the aquarium due to the electric field formed by the rotating magnetic shaft so that a coil in the aeration pump is unnecessary.

Further benefits and advantages of the present invention will become apparent after a careful reading of the detailed description with appropriate reference to the accompanying drawings.

DETAILED DESCRIPTION OF THE INVENTION

Figure 1:
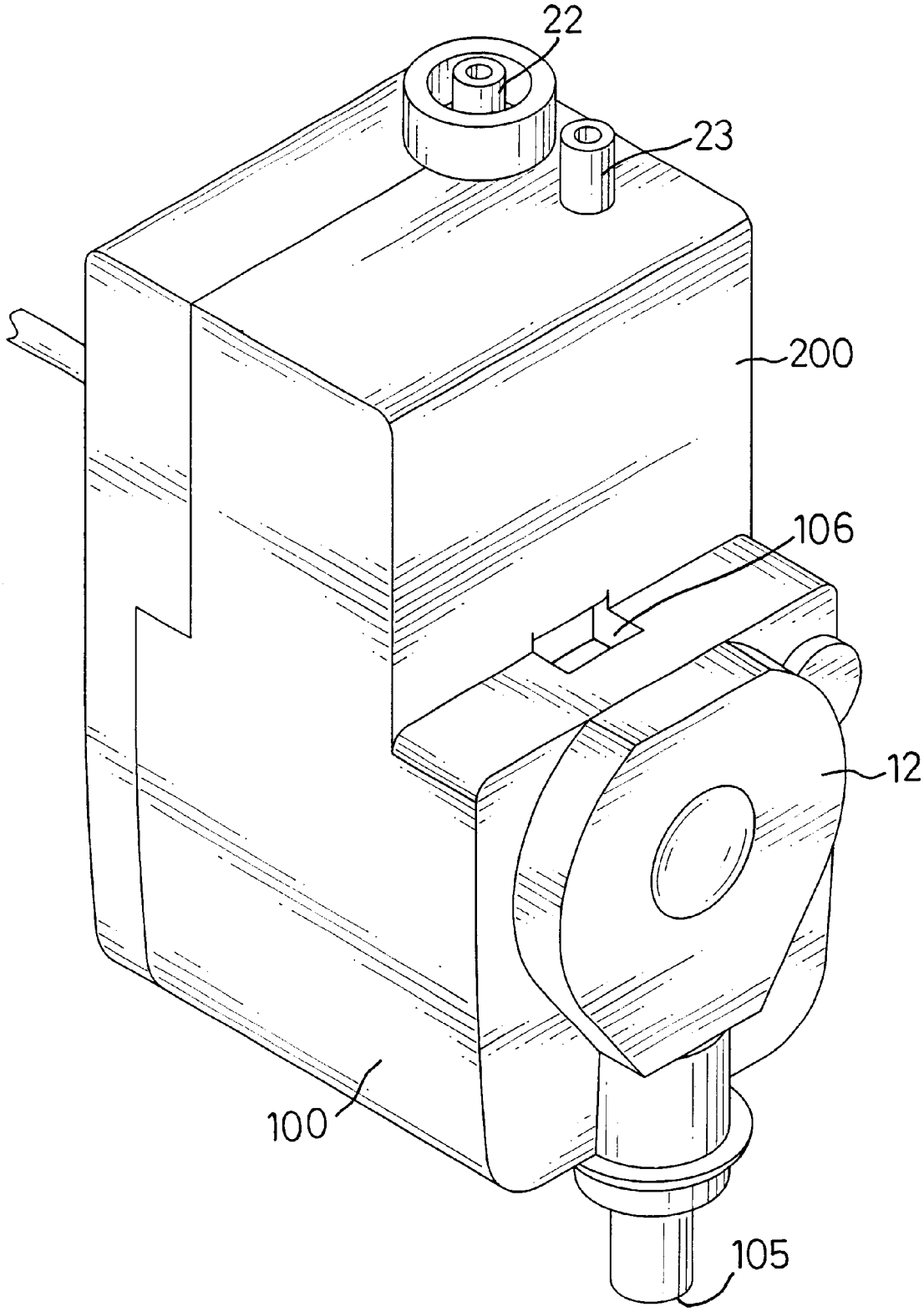
FIG. 1 is a perspective view of a pump assembly in accordance with the present invention for an aquarium.
Figure 2:
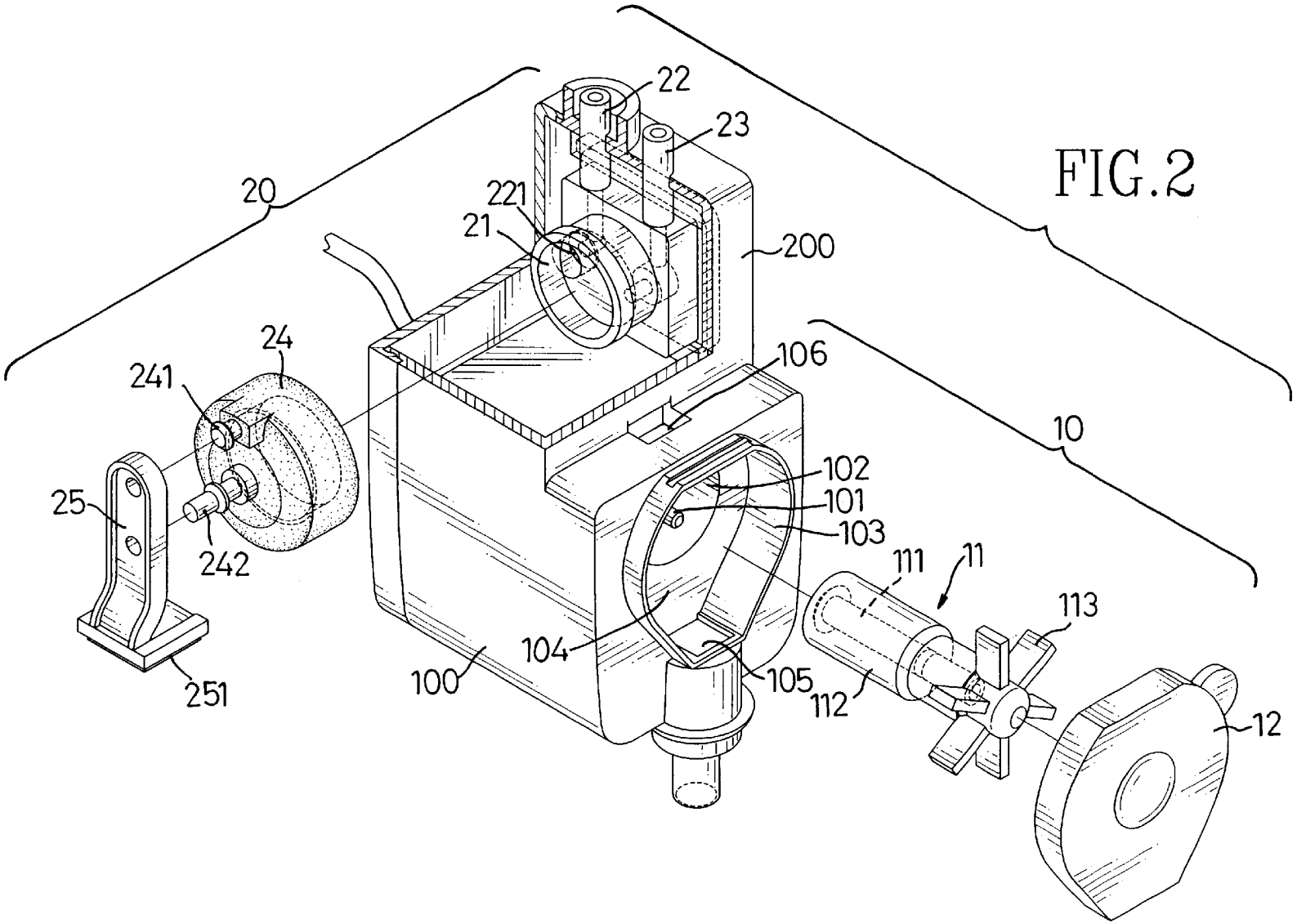
FIG. 2 is an exploded perspective view of the pump assembly in FIG. 1.
Figure 3:
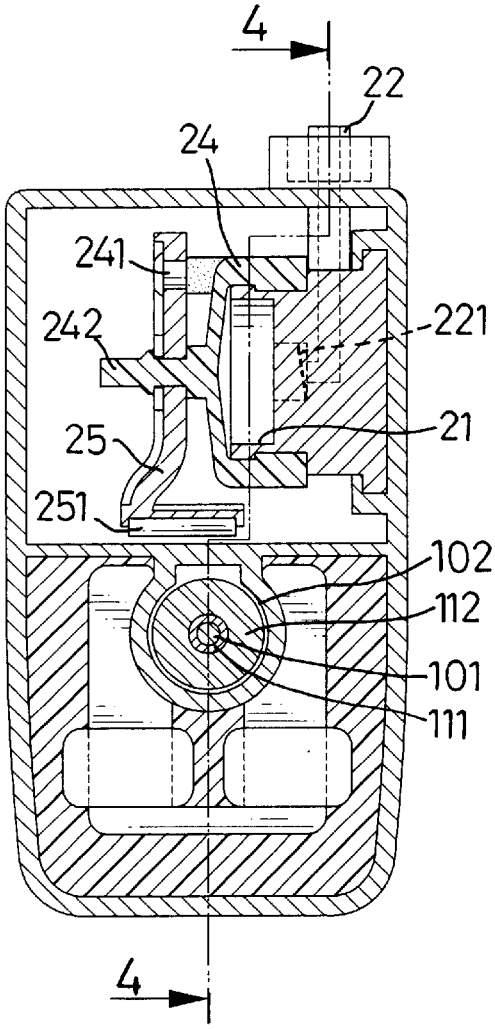
FIG. 3 is a cross-sectional side plan view of the pump assembly in FIG. 1.

With reference to FIGS. 1–3, a pump assembly in accordance with the present invention for an aquarium comprises a water circulation pump (10) and an aeration pump (20) manufactured in combination with each other.

The water circulation pump (10) includes a first casing (100), a rotor (11), a cover (12). The rotor (11) is mounted in the first casing (100). The first casing (11) has a first side, a second side, a top, a bottom and a stator device (not numbered) mounted on the bottom in the first casing (100). A positioning shaft (101) horizontally extending from the first side of the first casing (100) and a through hole (102) is defined in the second side to correspond to the positioning shaft (101). A flange (103) extends out from the second side of the first casing (100) around the through hole (102) and forms a pump cavity (104) within the flange (103). An outlet (105) is defined in the outer periphery of the first casing (100) and communicates with the pump cavity (104). An inlet (106) is defined in the outer periphery of the first casing (100) and communicates with the inside of the first casing (100).

The rotor (11) comprises a sleeve (111), a magnetic shaft (112) and an impeller (113). A longitudinal hole is centrally defined in the magnetic shaft (112) to be securely pressed onto the sleeve (111). The impeller (113) is also securely pressed onto the sleeve (111) so that when the magnetic shaft (112) rotates, the impeller (113) will rotate. The sleeve (111) is rotatably mounted on the positioning shaft (101), and the impeller is positioned in the pump cavity (104) in the first casing (100).

The cover (12) is attached to the flange (103) to close the pump cavity (104) and form a water channel from the inlet (106) to the outlet (105) via the pump cavity (104).

Figure 4:
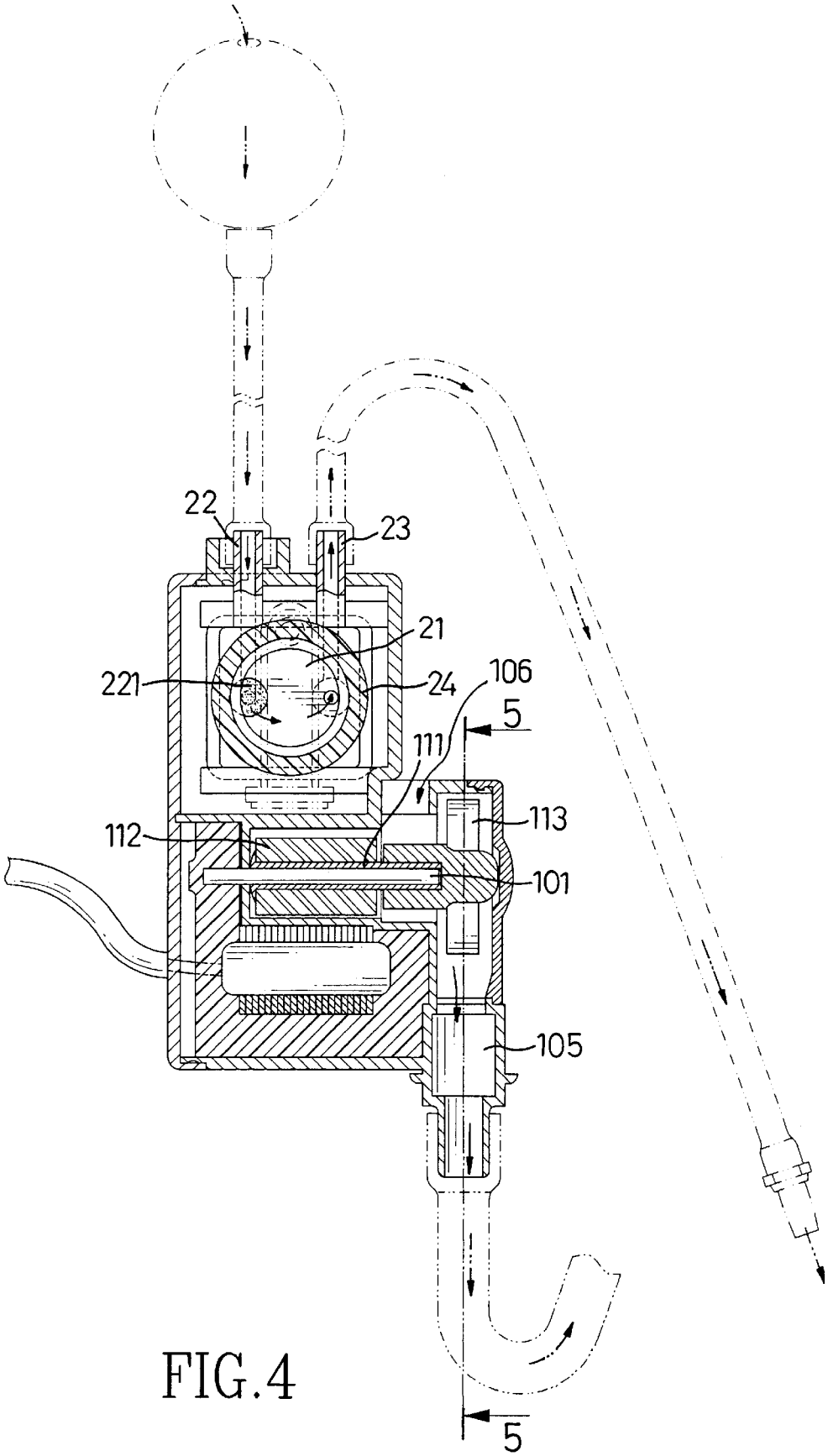
FIG. 4 is cross-sectional view front plan of the pump assembly along line 4—4 in FIG. 3.
Figure 6:
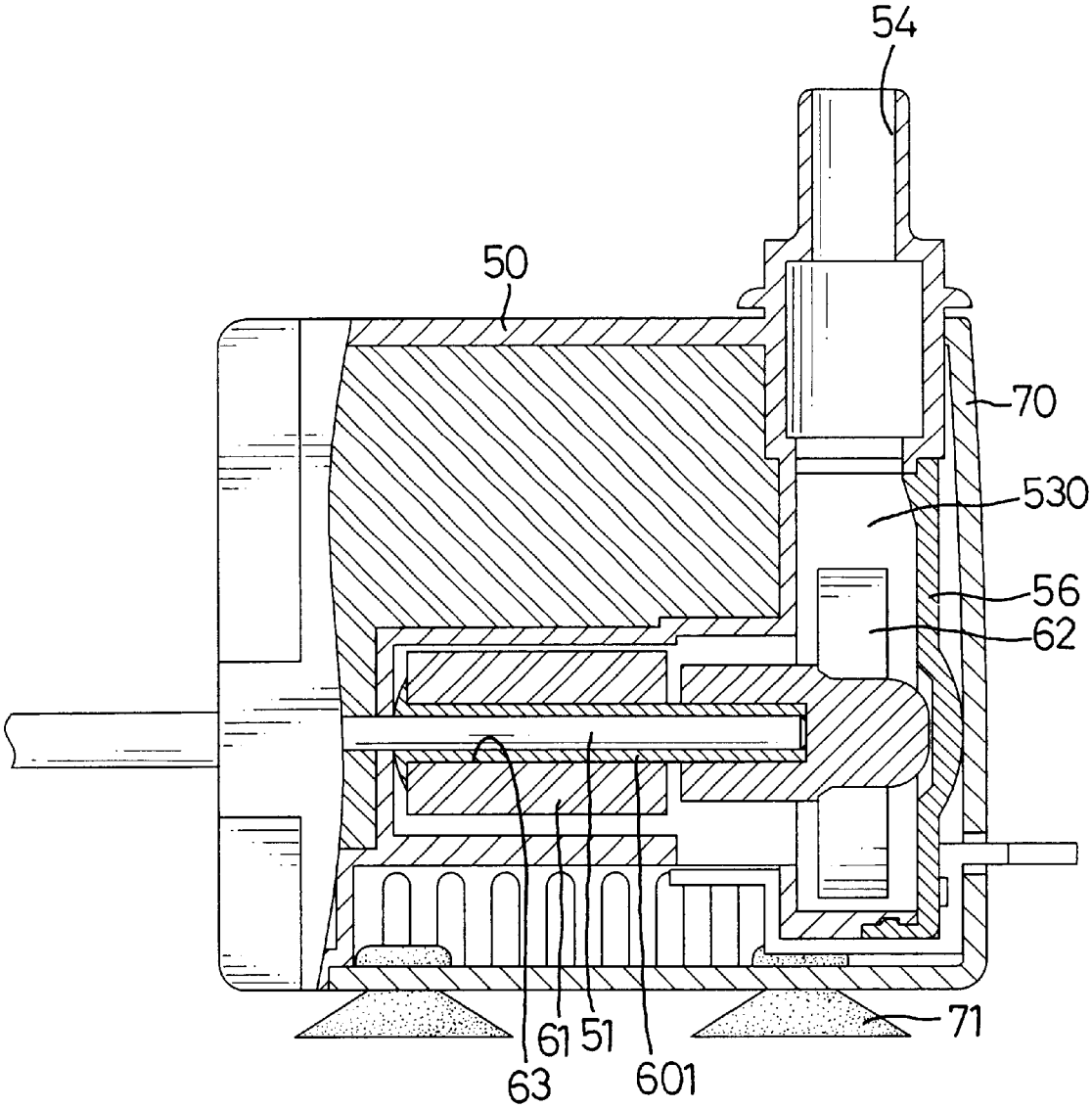
FIG.6 PRIOR ART
FIG. 6 is a front sectional view of a conventional water circulation pump for an aquarium in accordance with the prior art.
Figure 7:
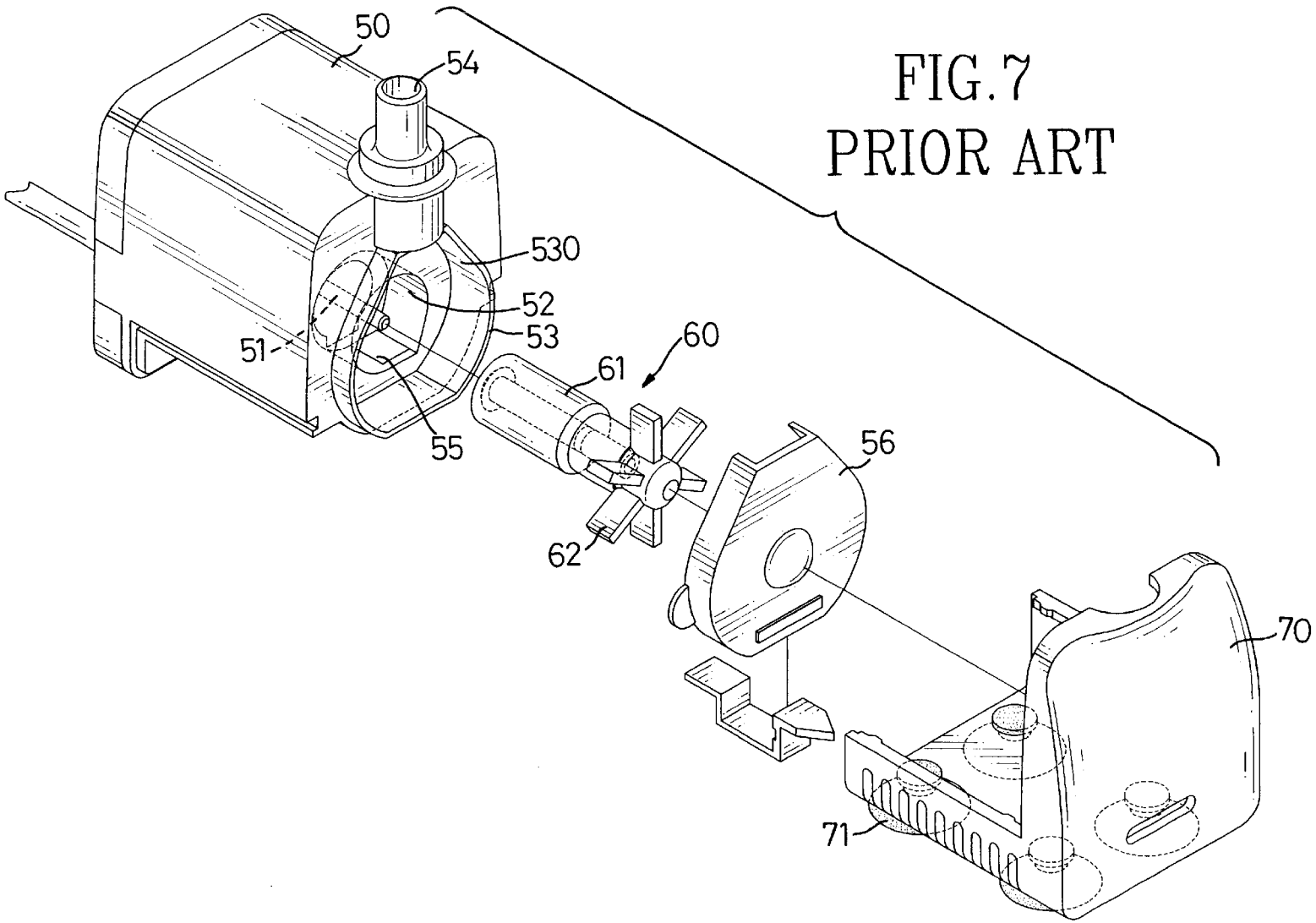
FIG. 7 PRIOR ART
FIG. 7 is an exploded view of the conventional water circulation pump in FIG. 6.
Figure 8:
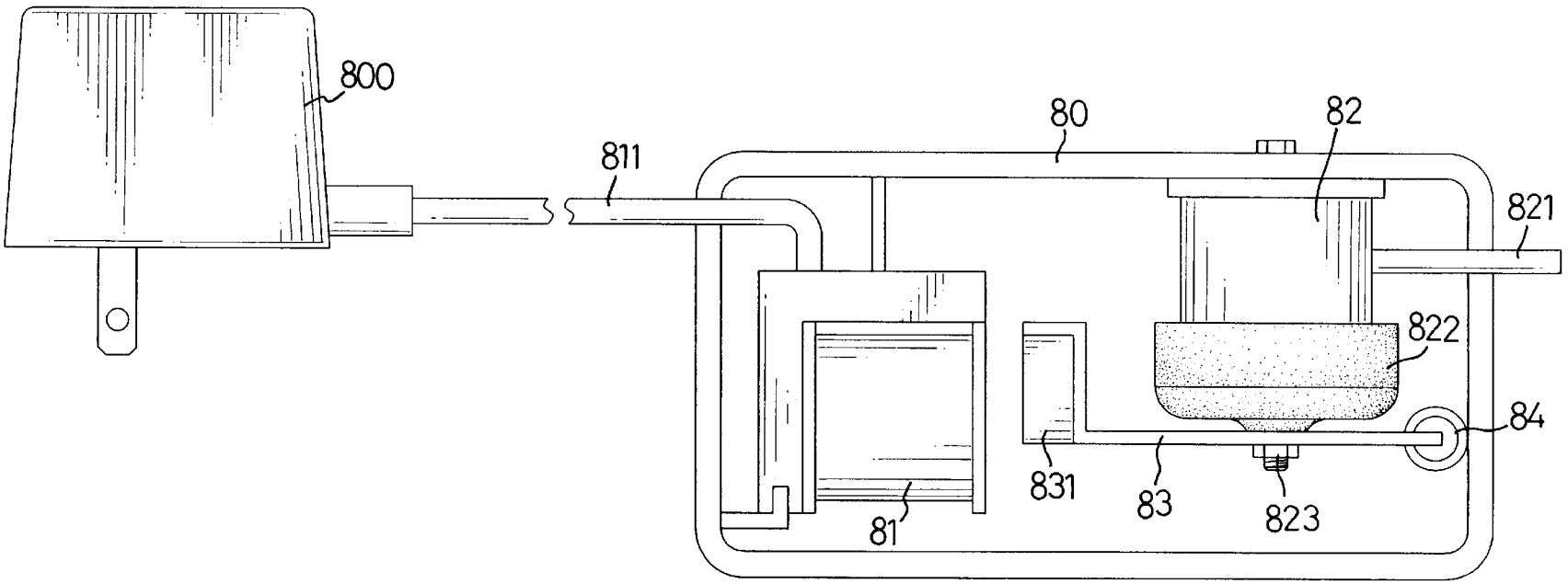
FIG.8 PRIOR ART
FIG. 8 is a cross-sectional front plan view of a conventional aeration pump for an aquarium in accordance with the prior art.

With reference to FIGS. 2, 3 and 4, the aeration pump (20) comprises a second casing (200), a cylinder (21), an inlet (22) and an outlet (23). The second casing (200) connected to the top of the first casing (100) of the water circulation pump (10). In the preferred embodiment of the present invention, the first casing (100) and the second casing (200) are formed integrally. The cylinder (21) is formed on one side of the second casing (200). The inlet (22) and outlet (23) are respectively defined in the outer periphery of the second casing (200) and communicate with the inner periphery of the cylinder (21). The inlet (22) is adapted to connect to a flexible tube, and the free end of the tube is connected to a ball floating on the water surface of the aquarium so that air can be drawn into the cylinder (21) and pumped into the aquarium. A check valve (221) is mounted in the cylinder (21) to selectively close the inlet (22) to prevent the air drawn into the pump from flowing back out of the pump. A diaphragm (24) is attached to and closes the cylinder (21) to form a closed air pump chamber in the cylinder (21). The diaphragm (24) includes a connecting stud (241) extending out from the edge of the diaphragm (24) and a protrusion (242) centrally extending from the outer periphery of the diaphragm (24). An L-shaped lever (25) is attached to the diaphragm (24) and has a first leg and a second leg. The first leg of the lever (25) is longer than the second leg of the lever (25). The first leg of the lever (25) has two through holes (not numbered) defined to receive the connecting stud (241) and the protrusion (242) of the diaphragm (24) to hold the lever (25) in place on the diaphragm (24). The second leg of the lever (25) faces the magnetic shaft (112) of the rotor (11), and a magnet (251) is secured on the second leg of the lever (25). The axis of the first leg of the lever (25) is perpendicular to the axis of the positioning shaft (101).

Figure 5:
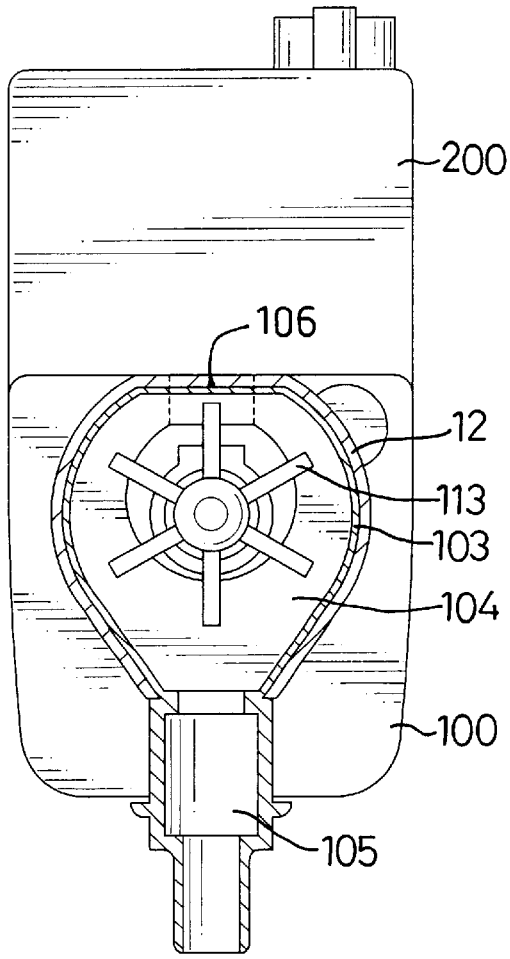
FIG. 5 is side plan view in partial section of the pump assembly along line 5—5 in FIG. 4.

With reference to FIGS. 4 and 5, to operate the pump assembly of the present invention, water is drawn into the pump cavity (104) through the inlet (106) and discharged into the aquarium from the outlet (105) by the impeller (113) of the rotor (11) to form a water current in the aquarium when the rotor (11) rotates. Simultaneously, the lever (25) continually reciprocates to draw air into the pump and discharge the air into the aquarium due to the rotating magnetic shaft (112) causing the magnet (251) to move so that the coil in the air pump is unnecessary with the present invention.

The pump assembly for an aquarium in accordance with the present invention has the following advantages.

1. It is convenient to operate. The user does not need to set up separate aeration and water pumps because the present invention combines the aeration pump and the water pump. Furthermore, the aeration pump and the water pump work at the same time.

2. Only one electromagnetic device is needed because the aeration pump is operated by the magnetic field of the rotating magnetic shaft.

3. The pump assembly of the present invention is cheap. Prior to the current invention, the user must prepare a water circulation pump and an aeration pump. Two pumps have two coils. However, the pump assembly of the present invention has only one coil and pumps water and air at the same time.

4. The pump assembly in accordance with the present invention saves energy. Two coils need two power supplies. However, the pump assembly of the present invention needs only one power supply and pumps water and air at the same time.

Although the invention has been explained in relation to its preferred embodiment, it is to be understood that many other possible modifications and variations can be made without departing from the spirit and scope of the invention as hereinafter claimed.

What is claimed is:

1. A pump assembly for an aquarium comprising:

a water circulation pump having a first casing and an aeration pump having a second casing, wherein the aeration pump is operated by a magnetic field formed by a rotating magnetic shaft that is rotatably mounted in the water circulation pump, and the first casing and the second casing are connected to each other.

2. The pump assembly for an aquarium as claimed in claim 1, wherein the first casing of the water circulation pump and the second casing of the aeration pump are formed integrally.

3. The pump assembly for an aquarium as claimed in claim 1, wherein the water circulation pump comprises:

a positioning shaft horizontally extending from a first side of the first casing, a sleeve rotatably mounted on the positioning shaft and a magnetic shaft having a longitudinal hole centrally defined to be securely pressed onto the sleeve; and the aeration pump comprises:

a cylinder formed on one side of the second casing, a diaphragm attached to and closing the cylinder to form a closed air pump chamber in the cylinder, and an L-shaped lever attached to a center of the diaphragm to actuate the diaphragm to pump air in the cylinder into the aquarium.

* * * * *